US005999630A

United States Patent [19]

Iwamatsu

[11] Patent Number: 5,999,630

[45] **Date of Patent: *Dec. 7, 1999**

[54] SOUND IMAGE AND SOUND FIELD CONTROLLING DEVICE

[75] Inventor: Masayuki Iwamatsu, Hamamatsu, Japan

[73] Assignee: Yamaha Corporation, Hamamatsu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/554,938

[22] Filed: Nov. 9, 1995

[30] Foreign Application Priority Data

Nov. 15, 1994 [JP] Japan ..... 6-305481

[51] Int. Cl.[6] ..... H04R 5/00

[52] U.S. Cl. ..... 381/17; 381/18; 381/63; 84/630; 84/DIG. 26

[58] Field of Search ..... 381/1, 17, 18, 381/19, 61, 63, 62, 86; 84/629, 630, 707, DIG. 26

[56] References Cited

U.S. PATENT DOCUMENTS

| | | | |
|---|---|---|---|
| 4,118,599 | 10/1978 | Iwahara et al. | 179/1 G |
| 4,603,429 | 7/1986 | Carver | 381/18 |
| 4,731,848 | 3/1988 | Kendall et al. | 84/DIG. 26 |
| 4,803,731 | 2/1989 | Niimi et al. | 84/DIG. 26 |
| 4,980,914 | 12/1990 | Kunugi et al. | 381/1 |
| 5,027,687 | 7/1991 | Iwamatsu | 84/600 |
| 5,040,219 | 8/1991 | Ando et al. | 381/61 |
| 5,046,097 | 9/1991 | Lowe et al. | 381/17 |
| 5,105,462 | 4/1992 | Lowe et al. | 381/17 |
| 5,119,420 | 6/1992 | Kato et al. | 381/1 |
| 5,195,140 | 3/1993 | Kudo et al. | 84/630 |
| 5,201,005 | 4/1993 | Matsushita et al. | 84/630 |
| 5,261,005 | 11/1993 | Masayuki | 381/18 |
| 5,305,386 | 4/1994 | Yamato | 381/17 |
| 5,381,482 | 1/1995 | Matsumoto et al. | 381/63 |
| 5,384,851 | 1/1995 | Fujimori | 381/17 |
| 5,386,082 | 1/1995 | Higashi | 381/1 |
| 5,440,639 | 8/1995 | Suzuki et al. | 381/17 |
| 5,452,360 | 9/1995 | Yamashita et al. | 381/63 |
| 5,467,401 | 11/1995 | Nagamitsu et al. | 381/17 |
| 5,524,053 | 6/1996 | Iwamatsu | 381/18 |
| 5,546,465 | 8/1996 | Kim | 381/18 |
| 5,555,306 | 9/1996 | Gerzon | 84/630 |
| 5,572,591 | 11/1996 | Numazu et al. | 381/18 |
| 5,596,645 | 1/1997 | Fujimori | 381/17 |
| 5,598,478 | 1/1997 | Tanaka et al. | 381/17 |
| 5,680,464 | 10/1997 | Iwamatsu | 381/63 |
| 5,684,881 | 11/1997 | Serikawa et al. | 381/86 |
| 5,710,818 | 1/1998 | Yamato et al. | 381/86 |

FOREIGN PATENT DOCUMENTS

| | | |
|---|---|---|
| 61-262000 | 11/1986 | Japan . |
| 2-211799 | 8/1990 | Japan . |
| 2-261300 | 10/1990 | Japan . |
| 4-150400 | 5/1992 | Japan . |
| 4-225700 | 8/1992 | Japan . |

*Primary Examiner*—Curtis A. Kuntz
*Assistant Examiner*—Xu Mei
*Attorney, Agent, or Firm*—Graham & James LLP

[57] ABSTRACT

On the basis of localization control data, a sound image localization controlling circuit reproduces input audio signals via a plurality of speakers after having applied predetermined delay-involving signal processing to the audio signals, to thereby perform sound image localization processing to localize sound images of direct sounds in a desired range including an area outside a space surrounded by the speakers. The audio signals are also supplied to a sound field controlling circuit after having been delayed by a predetermined time. The sound field controlling circuit performs operations to convolute the audio signals with reflected sound parameters so as to generate reflected sounds. The output signals of the sound image localization controlling circuit and sound field controlling circuit are fed to adders each adding together the signals of same channel. The resultant added signals are then sent to the speakers in a listening room for audible reproduction.

4 Claims, 14 Drawing Sheets

FIG. 12A
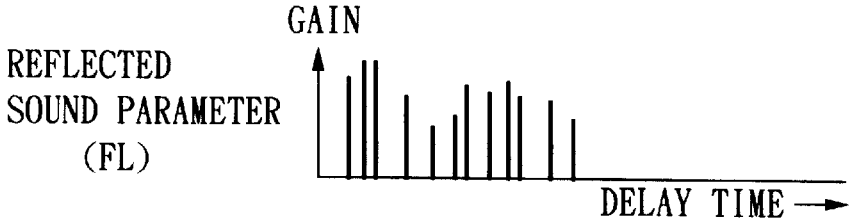
FIG. 12B
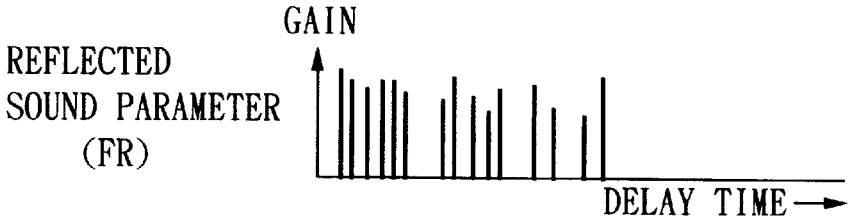
FIG. 12C
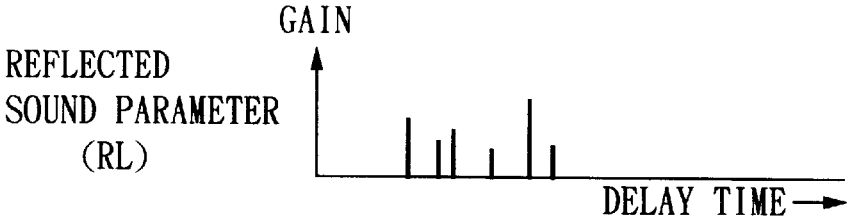
FIG. 12D
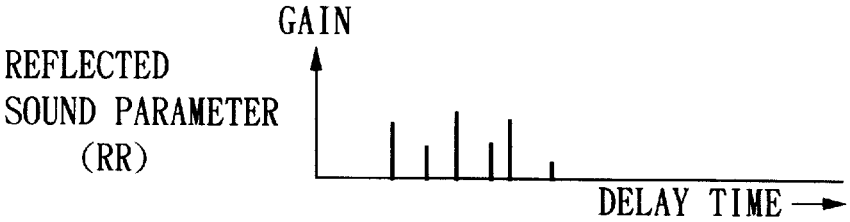
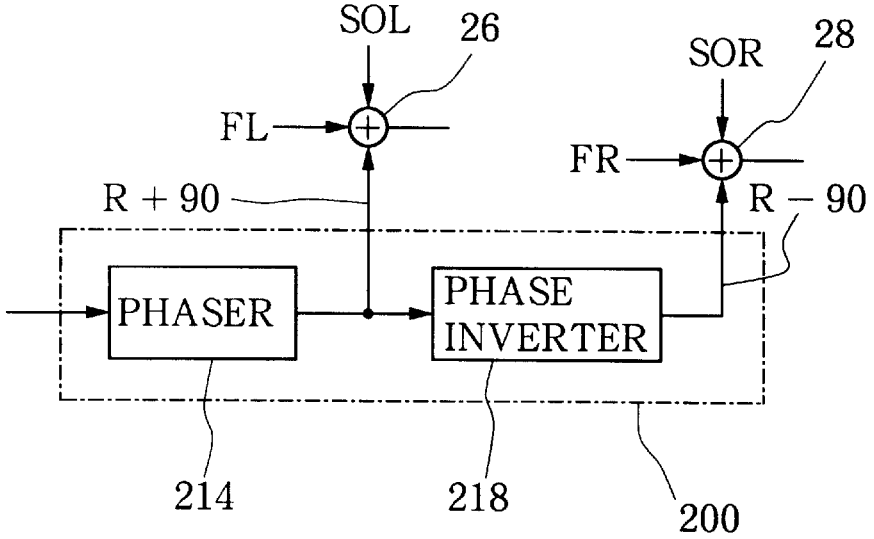
FIG. 13

SOUND IMAGE AND SOUND FIELD CONTROLLING DEVICE

BACKGROUND OF THE INVENTION

The present invention relates generally to a system for reproducing input audio signals via a plurality of speakers after having applied predetermined delay-involving signal processing to the audio signals, to thereby localize sound images of direct sounds in a desired range including areas outside a space surrounded by the speakers. More particularly, the present invention relates to a technique to, while realizing a good sound image localization effect, achieve a spatial impression and a feeling of depth as if sound images were in a real sound field space.

The sound image localization techniques are generally intended for freely controlling sound images to be localized beyond the positional restrictions of speakers, and one such technique is known which is based on cancellation of the so-called "cross talks" between the two ears of a listener (inter-ear cross talk cancellation method, e.g., U.S. Pat. No. 4,118,599 and U.S. Pat. No. 5,384,851) as will be described below.

According to the conventional stereophonic reproduction, as shown in FIG. 2, sound images are localized in a sectorial plane extending from speakers 10 and 12 away for a listener 14 within an included angle $\alpha$ (i.e., the range denoted by hatching in the figure). The reason why the sound image localization is limited to the range within the included angle $\alpha$ is the presence of interear cross talk components. Namely, as shown in FIG. 3, the sound output from the right speaker 12 reaches the right ear of the listener 14 and also reaches the listener's left ear slightly later than the right ear. In this case, the part or component of the right-speaker sound reaching the left ear is called the inter-ear cross talk. Similarly, the sound output from the left speaker 10 has a cross talk component reaching the listener's right ear.

In the example of FIG. 3, it is possible to cancel the cross talk component and localize the sound image outside the right speaker 12, by outputting via the left speaker 10 a reverse-phase signal at appropriate timing to cancel out the sound reaching the left ear from the right speaker 12, as shown in FIG. 4. Complete cancellation of the cross talk component permits a sound image to be localized just on the right-hand side of the listener 14 as depicted at R'. If the listener 14 is in the middle between the speakers 10 and 12, the distances between the ears and speakers 10, 12 equal, and time delay of the cross talks with respect to the main sounds, at the most, falls within a time corresponding to the inter-ear distance. Thus, assuming that the listener's inter-ear distance is 20 cm, the cross talk time delay will be about 0.6 ms. This means that the cross talks can be cancelled out by generating reverse-phase cancelling signals 0.6 ms later than the original or main signals.

Various other sound localization techniques than the above-mentioned are also known, such as one simulating a transfer function between ears of a listener and left and right loudspeakers and (disclosed in, for example, U.S. Pat. No. 5,046,097 and U.S. Pat. No. 5,105,462), and another simulating an auditory frequency sensitivity in a vertical direction so as to localize a sound image in a position above a speaker.

Although the known sound image localization control can localize a sound image of a direct sound outside a space surrounded by a plurality of speakers, spatially reflected sounds of the localized sounds can not be produced by such control alone, so that the localized sounds would unavoidably present some unnaturalness as if only one sound were in a non-acoustic room and a feeling of a sound field could never be obtained in the past. Theoretically, it may be possible to impart the sound field effect by providing a multiplicity of sound image localization control systems to localize reflected sound images in different positions to thereby produce multiple spatially reflected sounds around the listener. But, this approach requires an increased size and cost of the device employed and never allows a multiplicity of like sounds to be aurally differentiated from one another, thus making it unrealistic to attain the effect of causing the listener to feel spatially reflected sounds through processes based on the above-mentioned principle. This is because any cross talk signals must be completely removed in order to achieve cancellation of the inter-ear cross talks for a sound image localization effect. Namely, there arises no problem with signals to be used for localization of a single sound source. Also, a good localization effect can be obtained even with signals to be used for two or more sound sources as long as they are sufficiently different in nature, because these signals are so independent of each other to cause no significant interferences therebetween. However, where sound images of a plurality of signals of similar nature are to be localized simultaneously, respective cross talk signals would inevitably resemble each other to bring about unwanted interferences therebetween, thus increasing the possibility of impairing the cross talk cancellation effect. Further, where a plurality of spatially reflected sounds originating from a given sound source are to be localized one by one on the principle of the above-mentioned sound image localization processing, the reflected sounds tend to be generally similar in nature since they are from the same original sound. By contrast, cancelling signals responsive to subtle differences in time and direction are highly correlated to each other so that they cause interferences therebetween which impair the cross talk cancellation effect.

SUMMARY OF THE INVENTION

It is therefore an object of the present invention to provide a sound image and sound field controlling device, for use in a sound image localization system controlling sound image localization of a direct sound, which is, by simple construction, capable of generating spatially reflected sounds of localized sounds to create a feeling of a sound field, and also achieving a good sound image localization effect and a good sound field effect by preventing the sound field impartment from adversely influencing the sound image localization.

To accomplish the above-mentioned object, the present invention provides a sound image and sound field controlling device which comprises a sound image localization controlling section and a sound field controlling section. The sound image localization controlling section reproduces an input audio signal via a plurality of speakers after having applied predetermined delay-involving signal processing to the audio signal, to thereby perform sound image localization processing to localize a sound image of a direct sound in a desired range including an area outside a space surrounded by the speakers. The sound field controlling section generates reflected sounds by reproducing the audio signals via the speakers after, on the basis of reflected sound data determined in correspondence with hypothetical sound source positions of possible reflected sounds in an acoustic space, having performed an operation to convolute the audio signal with impulse response characteristics of desired reflected sounds, to thereby perform sound field impartment processing to impart a sound field effect, the speakers being disposed in front of or around a predetermined sound-listening point so as to generate a multiplicity of the reflected sounds in the acoustic space or a model space similar thereto. The sound image localization processing is initiated on the input audio signal prior to the sound field impartment processing.

In the device thus arranged, a sound field can be imparted by simple construction because the sound field impartment is effected, separately from the sound image localization control of the direct sound. Further, because the sound image localization processing is initiated prior to the initiation of the sound field impartment processing so that the two processings are performed with some time difference, it is possible to prevent the impartment of the sound field effect from adversely influencing the sound image localization to thereby attain good results in both the sound image localization and the sound field effect impartment.

The sound field impartment processing by the sound field controlling section is preferably initiated after completion of the sound image localization processing by the sound image localization controlling section. Because the sound image localization processing and sound field impartment processing are conducted in completely separate time zones, the best possible results can be attained in both of the processings.

In view of the fact that sound image localization of an audio signal is generally settled about 5 ms after the input of the audio signal, there is provided, in a preferred embodiment of the present invention, a time difference of at least 5 ms between the initiation of the sound image localization processing by the sound image localization controlling section and the initiation of the sound field impartment processing by the sound field controlling section. With this arrangement, the sound image localization processing and sound field impartment processing can be conducted in completely separate time zones, and there can be attained the best possible results in the sound image localization and sound field impartment.

For better understanding of other objects and features of the present invention, the preferred embodiments of the invention will be described in detail hereinbelow with reference to the accompanying drawings.

BRIEF DESCRIPTION OF THE DRAWINGS

In the drawings:

FIGS. 12A to 12D are diagrams showing examples of reflected sound parameters to be set in reflected sound generation circuits shown in FIG. 11;

FIG. 13 is a block diagram illustrating a detailed structural example of a phase processing circuit shown in FIG. 11;

DETAILED DESCRIPTION OF THE PREFERRED EMBODIMENTS

Figure 1:
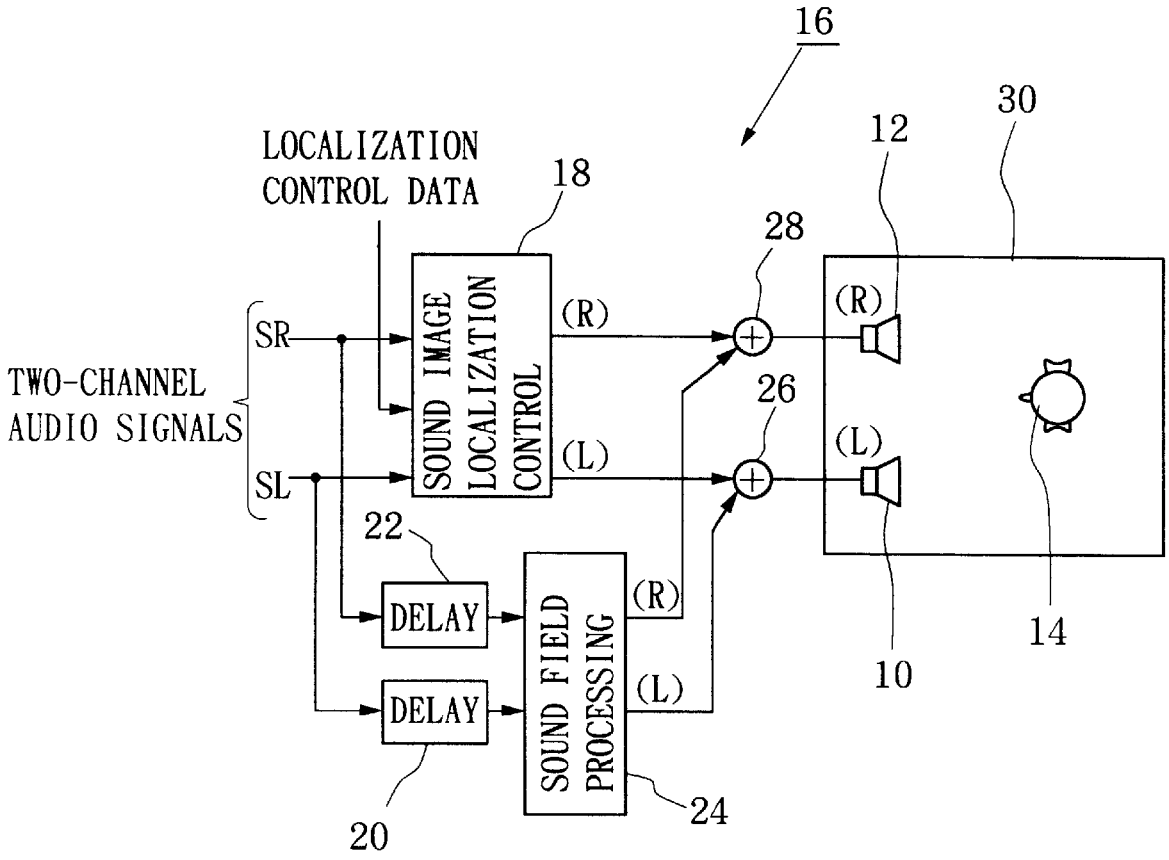
FIG. 1 is a block diagram illustrating the general structure of a sound image/sound field controlling device in accordance with an embodiment of the present invention.
Figure 2:
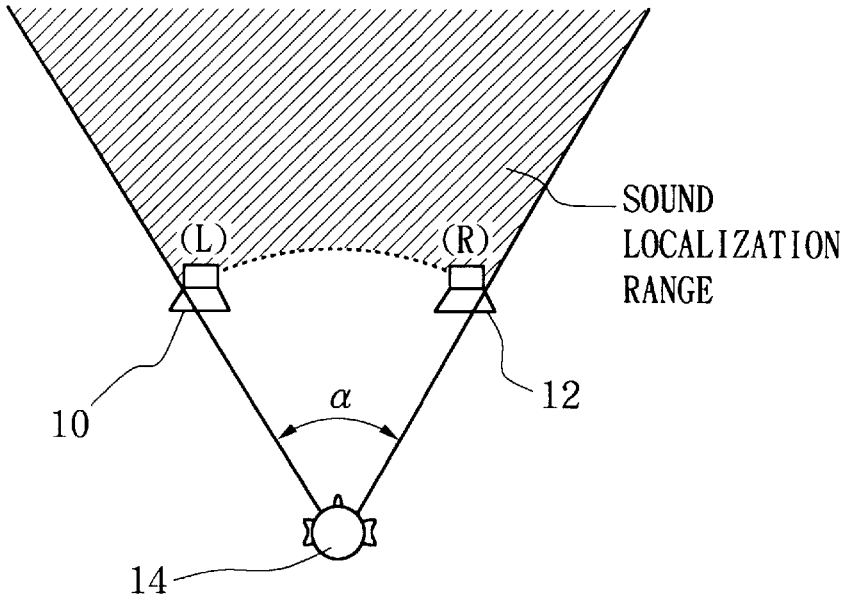
FIG. 2 PRIOR ART
FIG. 2 is a plan view showing sound image localization by a conventional stereophonic reproduction technique.
Figure 3:
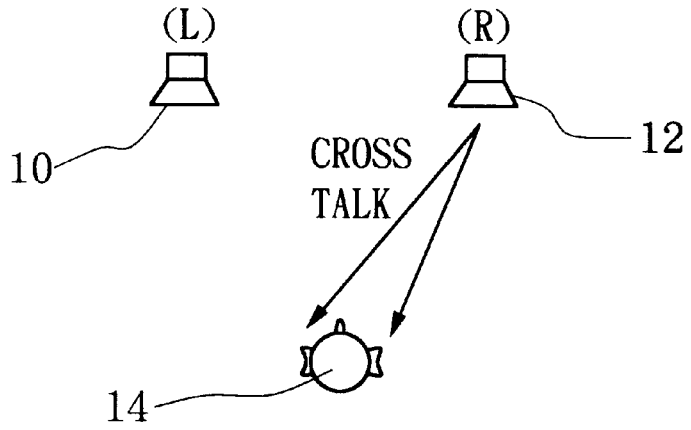
FIG. 3 PRIOR ART
FIG. 3 is a plan view explanatory of a cross talk caused in the conventional stereophonic reproduction of FIG. 2.
Figure 4:
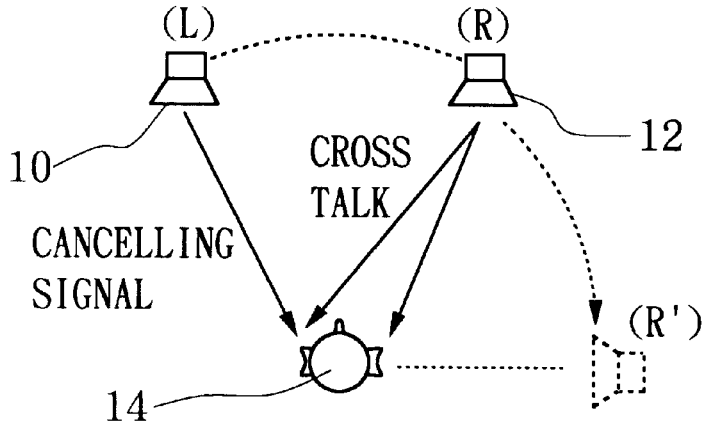
FIG. 4 PRIOR ART
FIG. 4 is a plan view explanatory of a principle to cancel the cross talk of FIG. 2.

In FIG. 1, there is shown a sound image/sound filed controlling device 16 in accordance with an embodiment of the present invention. This controlling device 16, as will be detailed hereinbelow, is designed to realize sound image localization and sound field effects by use of two speakers 10 and 12 and also perform sound field impartment processing by use of audio signals not having undergone sound image localization processing.

Two-channel stereo audio signals SL and SR for left and right channels are introduced into a sound localization controlling circuit 18, which, on the basis of predetermined localization control data, applies to the input audio signals SL and SR predetermined signal processing involving signal delaying operations so as to reproduce the audio signals through the speakers 10 and 12 in such a manner that the resultant sound images of direct sounds are localized in a range including areas outside a particular space surrounded by these speakers 10 and 12. The input audio signal SL and SR are also supplied to delay circuits 20 and 22 to be delayed by a same predetermined time and are then delivered to a sound field processing circuit 24. The sound field processing circuit 24 generates reflected sounds by reproducing the audio signals via the speakers 10 and 12 after, on the basis of reflected sound data determined in correspondence with hypothetical sound source positions of possible reflected sounds in an acoustic space, having performed operations to convolute the audio signals with impulse response characteristics of desired reflected sounds, to thereby perform sound field impartment processing to impart a sound field effect. The speakers 10 and 12 are disposed in front of or around a predetermined sound-listening point (i.e., listener 14) so as to generate a multiplicity of the reflected sounds in an acoustic space or model space similar thereto. Left- and right-channel output signals of the sound localization controlling circuit 18 and sound field processing circuit 24 are sent to adders 26 and 28, respectively, so that each of the adders 26 or 28 adds together the signals of same channel (left or right channel). The resultant added signals are then supplied to the speakers 10 and 12 in a listening room 30 for audible reproduction or sounding.

The sound image localization controlling circuit 18 requires a predetermined time (e.g., about 5 ms) for settlement of the sound localization, because of the delay-involving signal processing. The delay circuits 20 and 22 are provided to set a predetermined inhibition period in the sound field impartment processing, because the impartment processing is performed in the circuit 24 after the settlement of the sound image localization. To this end, the delay circuits 20 and 22 are set to a delay time of about 5 ms (t=0.5 ms). In this way, the sound image localization processing is first performed on the input audio signals SL and SR, and then the sound field impartment processing is performed only after the sound image localization is completely or substantially settled. This prevents the sound localization from being influenced by the sound field impartment, and thus the best possible results can be attained in the sound localization and sound field impartment effects.

Strictly speaking, because of the delay time t in the delay circuits 20 and 22, it is necessary to cut the reflected sound parameters (impulse response characteristics) to be used in the sound field controlling circuit 18 for a period of "0" to "t" to move forward the parameters by the time t. However, the delay time t in the order of 5 ms corresponds to a sound travel distance of about 1.7 m, and therefore, as long as the reflected sound parameters assume a wide acoustic space, reflected sound components from the wall surfaces surrounding the acoustic space will be contained only in the parameters after ten-odd ms. So, even if the reflected sound parameters are cut for a period of 5 ms or less, a desired sound field effect can be achieved without causing any unnatural feeling. Further, where the delay time t is contained in the reflected sound parameters, it is not necessary to provide such delay circuits 20 and 22.

Figure 5:
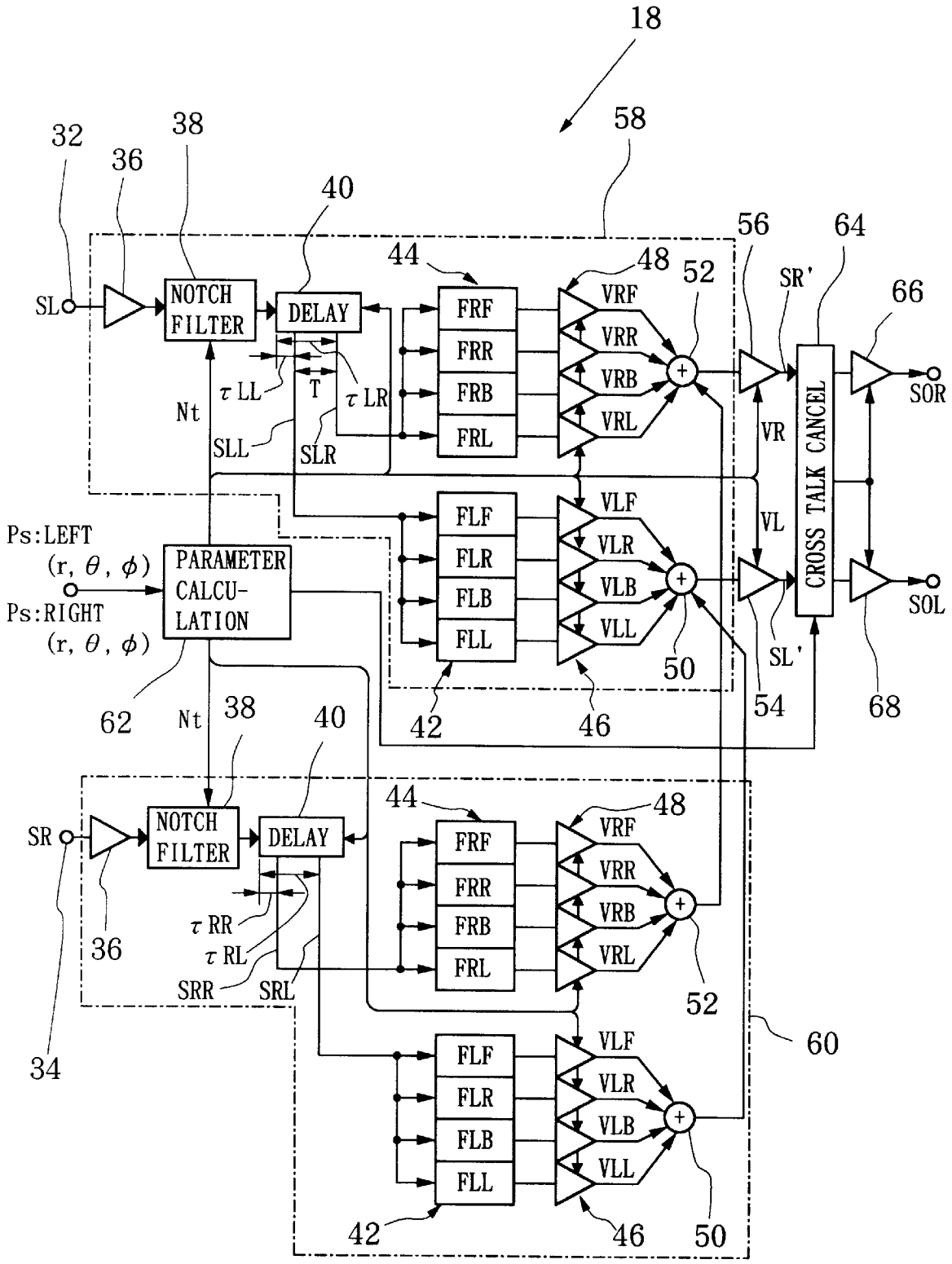
FIG. 5 is a block diagram illustrating a detailed structural example of a sound image localization circuit of FIG. 1.
Figure 6A:
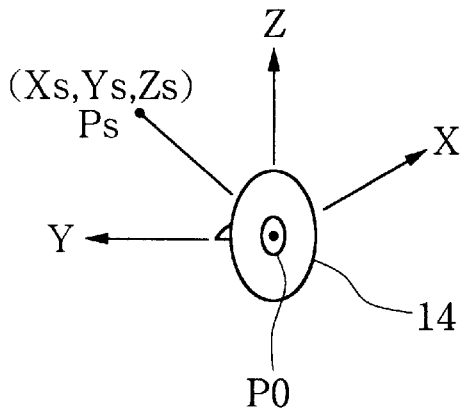
FIGS. 6A and 6B are diagrams explanatory of a sound image position as felt by a listener.
Figure 6B:
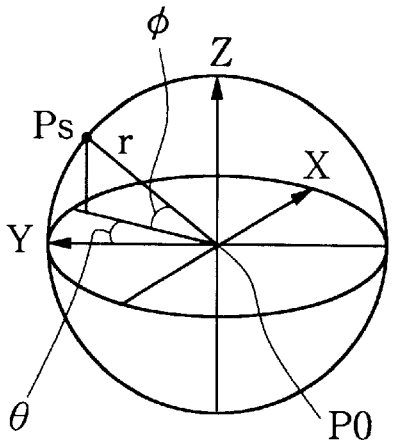

In FIG. 5, there is shown a detailed structural example of the sound image localization controlling circuit 18 of FIG. 1, which is designed to localize sound images in any desired positions by simulating transfer functions between left and right loudspeakers and ears of a listener. The controlling circuit 18 separately processes the left- and right-channel input signals SL and SR to be localized in respective desired positions, so as to effect stereophonic sound reproduction using the thus-set two sound image positions as hypothetical or virtual speaker positions. For purposes of description, assume that the middle point between the two ears of the listener 14 corresponds to the center P0 of three-dimensional coordinates and the rightward, forward and upward directions from the listener 14 facing in a reference direction (i.e., forward direction) correspond to the X, Y and Z axes, respectively, of an absolute coordinate system. It is also assumed herein that the coordinates of a sound image position of one channel to be set by the sound image localization processing is "Ps (Xs, Ys, Zs)", the distance from the center P0 to the sound image position Ps is "r", the horizontal angle (azimuth) of the sound image position Ps as viewed from the listener 14 (Y-axis direction) is "θ", and the elevation angle defined by the line ascending from the center P0 to the sound image position Ps is "ϕ". The coordinates values Xs, Ys, Zs of the sound image position Ps may be written as $$Xs=r \sin \theta \cos \phi$$

$$Ys=r \cos \theta \cos \phi$$

$$Zs=r \sin \phi$$

Figure 7A:
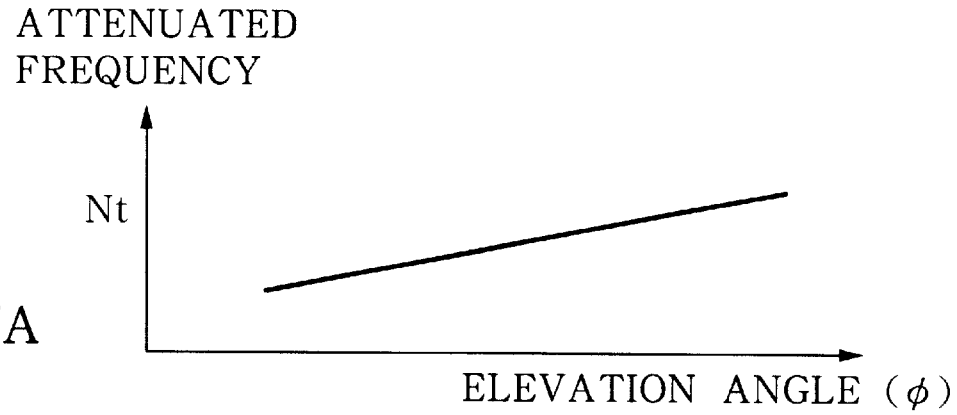
FIGS. 7A and 7B are graphs showing characteristics of a notch filter shown in FIG. 5.
Figure 7B:
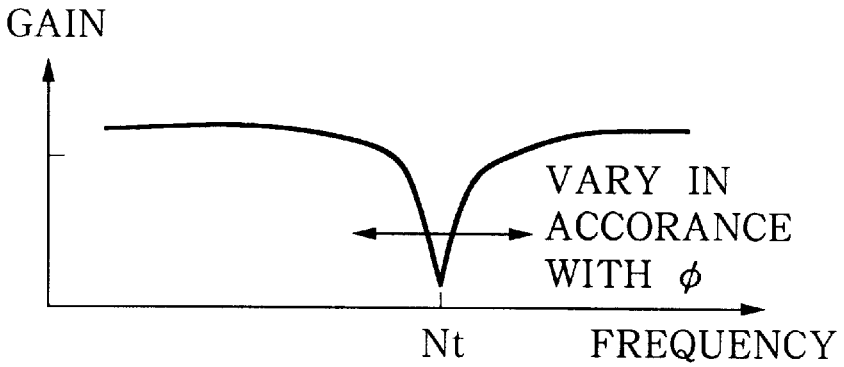

In FIG. 5, the left- and right-channel audio signals SL and SR are applied to input terminals 32 and 34 of left- and right-channel localization controlling circuits 58 and 60, respectively. In the left-channel localization controlling circuit 58, the left-channel audio signal SL applied to the input terminal 32 is then fed to a notch filter 38 via an amplifier 36. Utilizing the fact that human beings have auditory properties such that the listener's dead-zone frequency shifts higher as the elevation angle (i.e., vertical angle) of a sound image becomes greater, namely, as the sound image position lies higher, the notch filter 38 is set to have filter characteristics as shown in FIG. 7*b* where frequency Nt attenuated thereby varies as shown in FIG. 7A.

The output signal of the notch filter 38 is given to a delay circuit 40 to generate two signals SLL and SLR having a time difference T therebetween, of which signal SLL is one to be reproduced through the left-channel speaker 10 and signal SLR is one to be reproduced through the right-channel speaker 12. The time difference T is chosen to be a value corresponding to a difference in distance between the sound image position Ps and the left and right ears of the listener 14 (at the most, value of a time within which sound travels over a distance between the two ears, ordinarily about 20 cm). If the sound image is to be localized in a position on the left-hand side of the listener 14, delay time τLL of the signal SLL for the left-channel speaker 10 is set to be shorter than delay time τLR of the signal SLR for the right-channel speaker 12.

The output signals SLL and SLR of the delay circuit 40 are delivered to FIR (Finite Impulse Response) filters 42 and 44, respectively, which simulate head transfer functions for the left and right ears in such a case where sound images exist in four points right in front and rear and right to the left and right of the listener 14. Respective characteristics of the filters may be acquired by, for example, using a dummy head to measure responses at the left and right ears to impulse sounds that are sequentially generated by sequentially moving a sound source to the four points right in front and rear and right to the left and right of the listener 14. Namely, the individual filters are set to have the following characteristics:

- FLF: response at the left ear when the sound source is placed right in front of the listener 14;
- FLR: response at the left ear when the sound source is placed right on the right of the listener 14;
- FLB: response at the left ear when the sound source is placed right in the rear of the listener 14;
- FLL: response at the left ear when the sound source is placed just to the left of the listener 14;
- FRF: response at the right ear when the sound source is placed right in front of the listener 14;
- FRR: response at the right ear when the sound source is placed just to the right the listener 14;
- FRB: response at the right ear when the sound source is placed right in the rear of the listener 14; and
- FRL: response at the right ear when the sound source is placed just to the left of the listener 14.

Figure 8A:
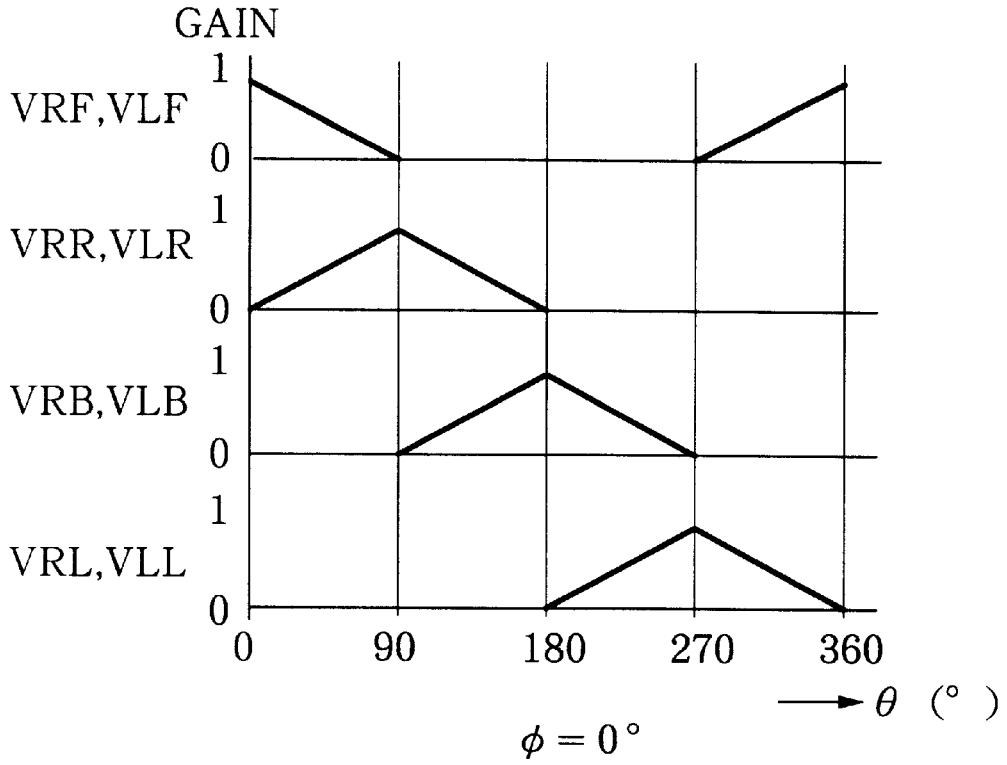
FIGS. 8A and 8B are graphs showing gain characteristics of amplifiers shown in FIG. 5.
Figure 8B:
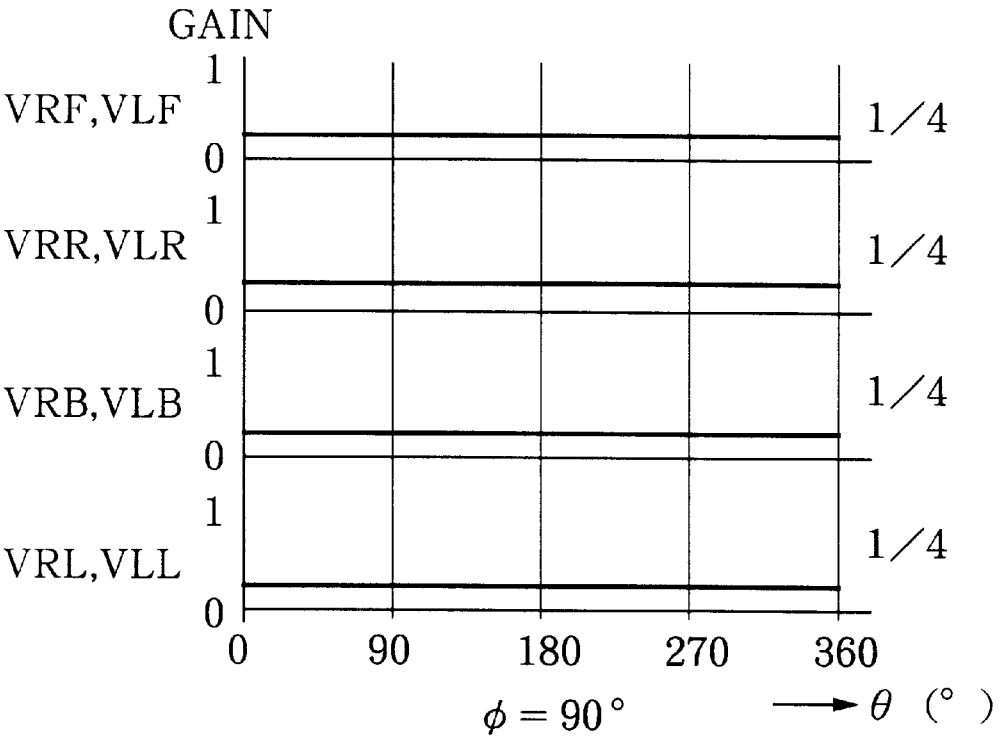

The four-direction output signals of the FIR filters 42 and 44 are fed to amplifiers 46 and 48, respectively. The amplifiers 46 and 48 serve to provide amplitude differences among the four-direction output signals of the FIR filters 42 and 44, respectively, depending on the sound image position Ps to be established, to thereby simulate functions of transfer from the sound image position Ps to the left and right ears. Respective gains VLF, VLR, VLB, VLL and VRF, VRR, VRB, VRL of the amplifiers 46 and 48 are variably controlled depending on the sound image position Ps. FIGS. 8A and 8B are graphs showing example values of the gains to be set in the embodiment. FIG. 8A shows the gains to be set in the case where the elevation angle $\phi$ is 0; where sound images are to be established in the four positions, right in front ($\theta$=0°), just to the right ($\theta$=90°), right in the rear ($\theta$=180°) and just to the left ($\theta$=270°) of the listener 14, each of the corresponding gains is set to "1", otherwise it is set to "0". There sound images are to be established in intermediate positions between the above-mentioned four positions, each of the gains is set in accordance with a gain ratio between two points on both sides of a corresponding sound image (the gain values at the two points total "1" and vary depending on the relative locations of the two points).

FIG. 8B shows the gains to be set in the case where the elevation angle $\phi$ is 90°, i.e., where a sound image is to be established right above the listener. In this case, no sound image movement occurs by the azimuth $\theta$, and thus the four-position components are uniformly set to a gain of ¼ (totalling 1). If the elevation angle $\phi$ is between 90° and 180°, the gains are varied successively from the conditions of FIG. 8A to those of FIG. 8B. Namely, as the elevation angle $\phi$ increases, the mountain-shaped characteristics of the gains gradually diminish, and the gains assume flat characteristics of FIG. 8B at $\phi$=90°.

Referring back to FIG. 5, the output signals of the amplifiers 46 and 48 are added together by adders 50 and 52 and then passed to balancing amplifiers 54 and 56, respectively. The balancing amplifiers 54 and 56 adjust the left and right sound volumes to balance in accordance with a difference in distance between the sound image position Ps to be established and the two ears, so as to localize a sound image in the position Ps. In the above-mentioned manner, it is possible to localize the sound image of the left-channel input signal SL in the desired position Ps.

The right-channel localization controlling circuit 60 is constructed similarly to the left-channel localization controlling circuit 58 described above and operates in such a manner to localize the right-channel input signal SR in a desired sound image position Ps different from that of the left-channel input signal SL. In order to localize a sound image in a position on the right-hand side of the listener 14, delay time $\tau$RR of the signal SRR for the right speaker is set to a value smaller than delay time $\tau$RL of the signal SRL for the left speaker. The output signals of the right-channel localization controlling circuit 60 are supplied to the adders 50 and 52 of the left-channel localization controlling circuit 58, each of which added the output signal of for one of the speakers from the circuit 60 to the signal for the corresponding speaker from the circuit 58. The resultant added signals from the adders 50 and 52 are then fed to the balancing amplifiers 54 and 56, respectively.

Parameter calculation section 62 in FIG. 5 is supplied with left- and right-channel localization control data (data r, $\theta$ and $\phi$ designating sound image positions Ps), so as to control the frequency Nt attenuated by the notch filter 38, delay times $\tau$LL, $\tau$LR, $\tau$LR, $\tau$RR, $\tau$RL, gains VRF (=VLR), VRR (=VLR), VRB (=VLB), VRL (=VLL) of the amplifiers 46 and 48 and gains VL and VR of the balancing amplifiers 54 and 56 to have respective values corresponding to the designated left and right sound image positions Ps. In this way, the balancing amplifiers 54 and 56 output two-channel stereo signals SL' and SR' which serve to localize sounds corresponding to the left- and right-channel input signals SL and SR in the respective designated sound image positions Ps.

Figure 9:
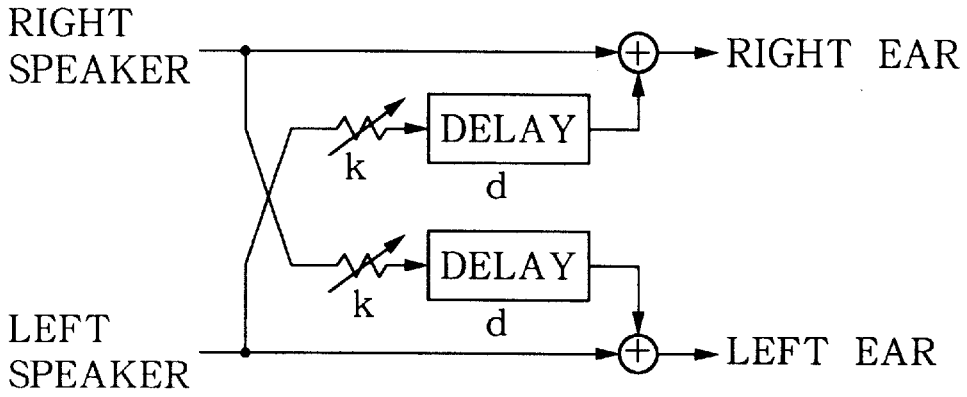
FIG. 9 is a diagram of an equivalent circuit of cross talks.

The thus-output two-channel stereo signals SL' and SR' are supplied to a cross talk canceller 64 which removes cross talks. Such cross talks may be expressed by an equivalent circuit of FIG. 9. For convenience of description, sound travel paths from the right speaker to the listener's right ear and from the left speaker to the listener's left ear are herein called "main paths", and sound travel paths from the right speaker to the listener's left ear and from the left speaker to the listener's right ear are called "cross talk paths". In this case, delay times d represent time differences between the time when the sound is propagated along the main paths and the time when the sound is propagated along the cross talk paths, and each reference character "k" represents a ratio of an attenuation amount of the sound propagated along the cross talk path to an attenuation amount of the sound propagated along the main path.

Figure 10:
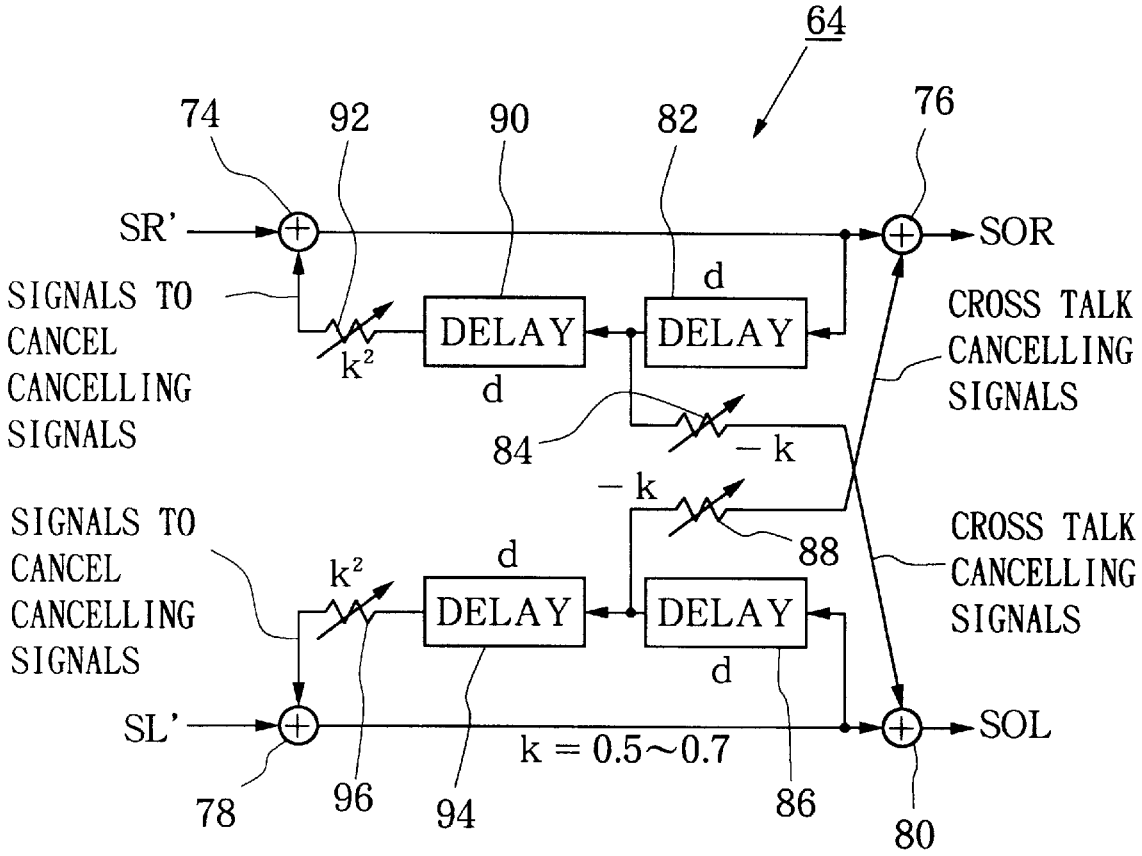
FIG. 10 is a circuit diagram illustrating a detailed structural example of a cross talk canceller shown in FIG. 5.

A description is given below about the detail of the cross talk canceller with reference to FIG. 10. The right-channel signal SR' having undergone the above-mentioned sound image localization processing is output from the canceller 64 via adders 74 and 76, while the left-channel signal SL' having undergone the above-mentioned sound image localization processing is output from the canceller 64 via adders 78 and 80. The right-channel signal SR' is also fed, as a cross talk cancelling signal, to the adder 80 via a delay circuit 82 and an attenuator 84, where it is added to the left-channel signal SL'. Similarly, the left-channel signal SL' is also fed, as a cross talk cancelling signal, to the adder 76 via a delay circuit 86 and an attenuator 88.

Each of these cancelling signals will itself reach the opposite (non-target) ear, and hence some other signals are necessary to cancel the cancelling signals. Such signals to cancel the cancelling signals, which have to be in phase with the original signals SL' and SR' and delayed behind the cancelling signals by time d, are generated via a delay circuit 90 and an attenuator 92, and via a delay circuit 94 and an attenuator 96, respectively. These circuits together form two feedback loops, in each of which cancellation of the corresponding cancelling signal is repeated a plurality of times in accordance with the attenuation amount ratio k. Assuming that 20 dB is a negligible level of the thus-attenuated cancelling signal, and k=0.7, the cancellation operation needs to be repeated about seven times ($(0.7)^n$=0.1). Because the delay time d corresponds to a distance between the listener's ears and is normally about 0.6 ms, a time required for repeating the cancellation operation seven times will be $$0.6\ \text{ms} \times 7 = 4.2\ \text{ms}$$

Since the operations in the circuits of FIG. 5 preceding the cross talk canceller 64 are virtually completed within a time corresponding to the delay time d, the sound image localization set by the sound image localization controlling circuit 18 can be completely settled in about 5 ms as a whole. U.S. Pat. Nos. 5,027,687 and 5,261,005 and U.S. patent application Ser. No. 204,526 disclose the prior art of the sound image localization technique.

Next, the detail of the sound field processing circuit 24 will be described with reference to FIG. 11. Two-channel source signals SL and SR are sent from a source instrument 110 to the sound image/sound field controlling device 16, via input terminals 112 and 114. In this example, the sound image/sound field controlling device 16 is constructed as a stereophonic main amplifier having a sound image/sound field controlling function, where the source signals SL and SR are introduced via a preamplifier 118 into a reflected sound signal generation section (sound field effect processor) 128 of the sound field processing circuit 24. The source signals SL and SR introduced into the reflected sound signal generation section 128 are synthesized by a mixer 130 into a single-channel signal of "SL−SR" or "SL+SR". The synthesized source signal is fed to a low-pass filter 132 which serves to prevent possible occurrence of aliasing noises in analog-to-digital conversion, and is then converted into digital representation by an A/D converter 134. The signal is delayed about 5 ms is by a delay circuit 135, so as to effect sound field impartment processing after the sound image localization processing is completed in the sound image localization controlling circuit 18. In addition, to impart frequency characteristics to reflected sounds, the delayed signal is passed through digital filters 136, 138, 140 and 142 for the individual channels and then sent to corresponding reflected sound generation circuits 144, 146, 148 and 150.

In ROM 152, there are prestored, as parameters for a variety of sound field effects, reflected sound parameters for the individual directions in various acoustic spaces (hall, studio, jazz club, church, "karaoke" room, etc.) as shown in FIG. 12. The reflected sound parameters comprise delay time data (ranging from, for example, 10 ms to 100 ms) and gain data. Each of the reflected sound generation circuits 144, 146, 148 and 150 performs a convolution operation on the source signal on the basis of optionally selected reflected sound parameters read out from the ROM 152, so as to generate reflected sound signals, for the corresponding channel, of the source signal. The thus-generated reflected sound signals from the circuits 144, 146, 148 and 150 are then time-divisionally converted into analog representation via a D/A converter 154. The outputs signals of the D/A converter 154 are then smoothed by means of corresponding low-pass filters 156, 158, 160 and 162, and ultimately output from the reflected sound signal generation section 128 in analog form.

Of the four-direction reflected sound signals, the signals RL and RR for the rear-left and rear-right directions are added together by an adder 196 and fed to a phase processing circuit 200, which processes the added signal to vary in phase in accordance with its frequency, so as to create two reflected sound signals R+90 and R−90 which are displaced in phase from each other by 180° and are substantially the same in amplitude level. A detailed structural example of the phase processing circuit 200 is shown in FIG. 13. In the phase processing circuit 200, a phaser 214 varies the phase of the signal in accordance with its frequency, and a phase inverter 218 inverts the phase of the phase-varied signal by 90°, so that the two reflected sound signals R+90 and R−90 are created which are displaced in phase from each other by 180 and are substantially the same in amplitude level. These signals R+90 and R−90 are added by the adders 26 and 28 to the left and right signals SOL+FL and SOR+RL, respectively.

Figure 14:
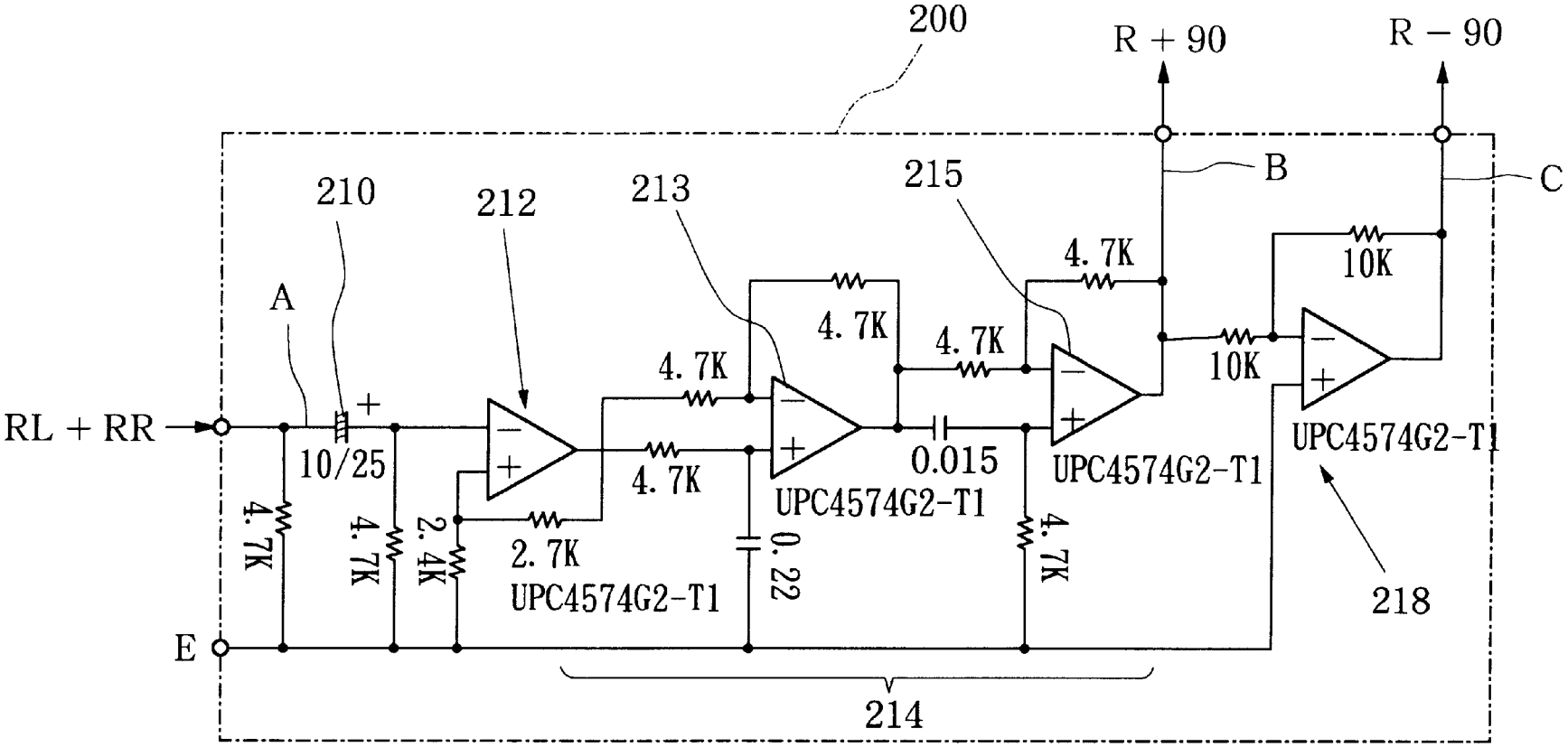
FIG. 14 is a circuit diagram showing in more detail the phase processing circuit of FIG. 13.

A detailed structural example of the phase processing circuit 200 is shown in FIG. 14. The added reflected sound signal RL+RR for the rear-left and rear-right directions is passed through a condenser 210 which removes D.C. components from the signal and then to the phaser 214 via an inverting amplifier 212. The phaser 214 is comprised of inverting amplifiers 213 and 215 for varying the phase of the signal in accordance with its frequency, and an inverting amplifier 218 for further inverting the phase of the signal so that the two reflected sound signals R+90 and R−90 are created which are displaced in phase from each other by 180° and are substantially the same in amplitude level.

Figure 15:
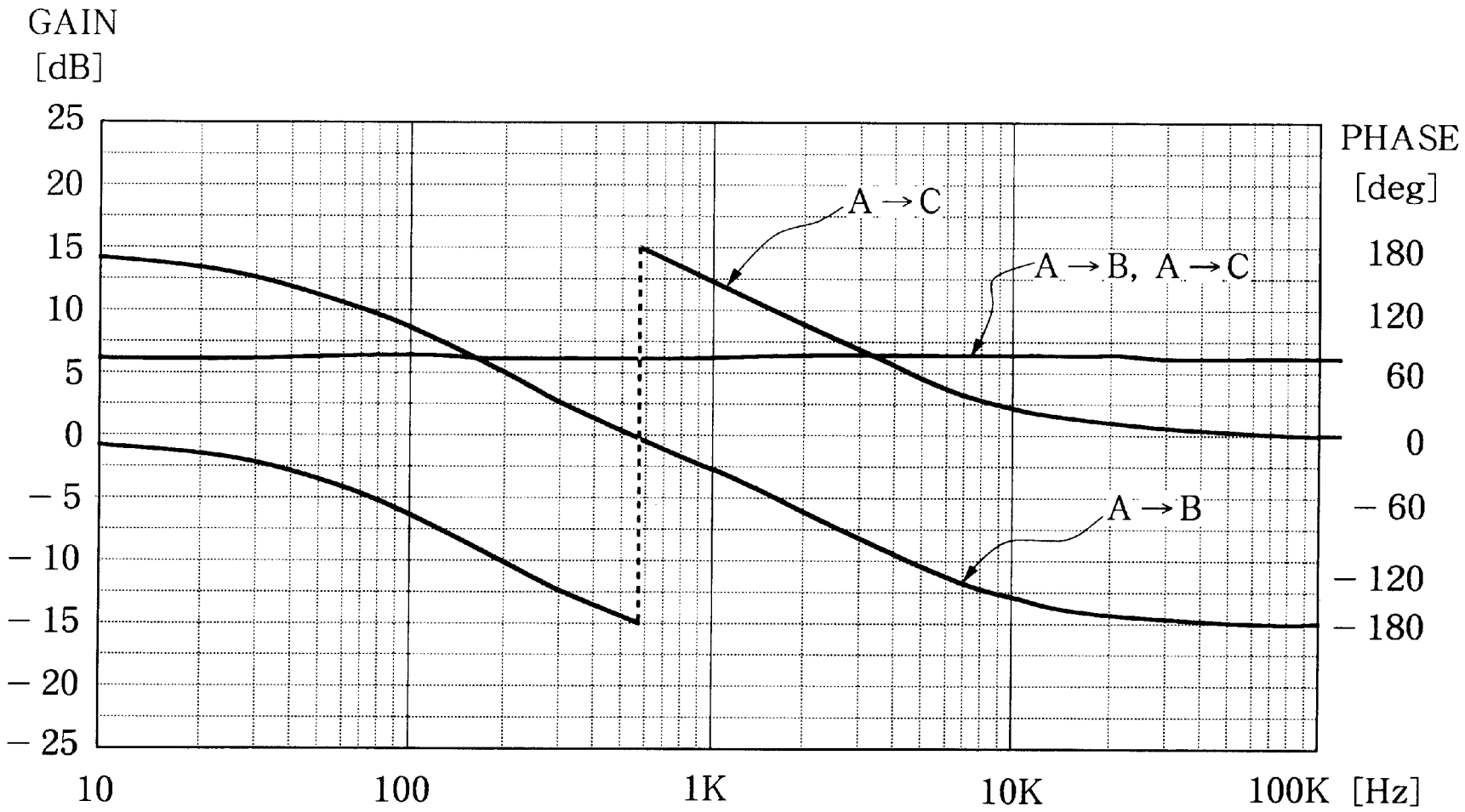
FIG. 15 is a graph showing gain and phase characteristics, versus frequency, of the phase processing circuit. of FIG. 14.

FIG. 15 shows gain and phase characteristics, versus frequency, of the phase processing circuit 200 of FIG. 14, where the gain presents flat characteristics in A–B and A–C regions, and the phase presents characteristics, in A–B and A–C regions, varying with the frequency while maintaining a phase difference of 180°.

Referring back to FIG. 11 the reflected sound signals R+90 and R−90 are added by the adders 26 and 28 to the reflected sound signals FL and FR for the front-left and front-right directions and the left- and right-channel source signals SOL and SOR (main signals having undergone the sound image localization control), respectively. The resultant added signals output from the adders 26 and 28 are led via power amplifiers 164 and 166 to speaker output terminals 172 and 174, respectively, by way of which the signals are supplied to respective speakers 184 and 184 (each of which may for example be a speaker of a cassette deck provided with a radio) disposed in front of a sound listening point 182 (i.e., listener 14). In this manner, the main and reflected sound signals will be reproduced from the main speakers 184 and 186 with a feeling of stereophonic sound localization and spatial impression.

Figure 11:
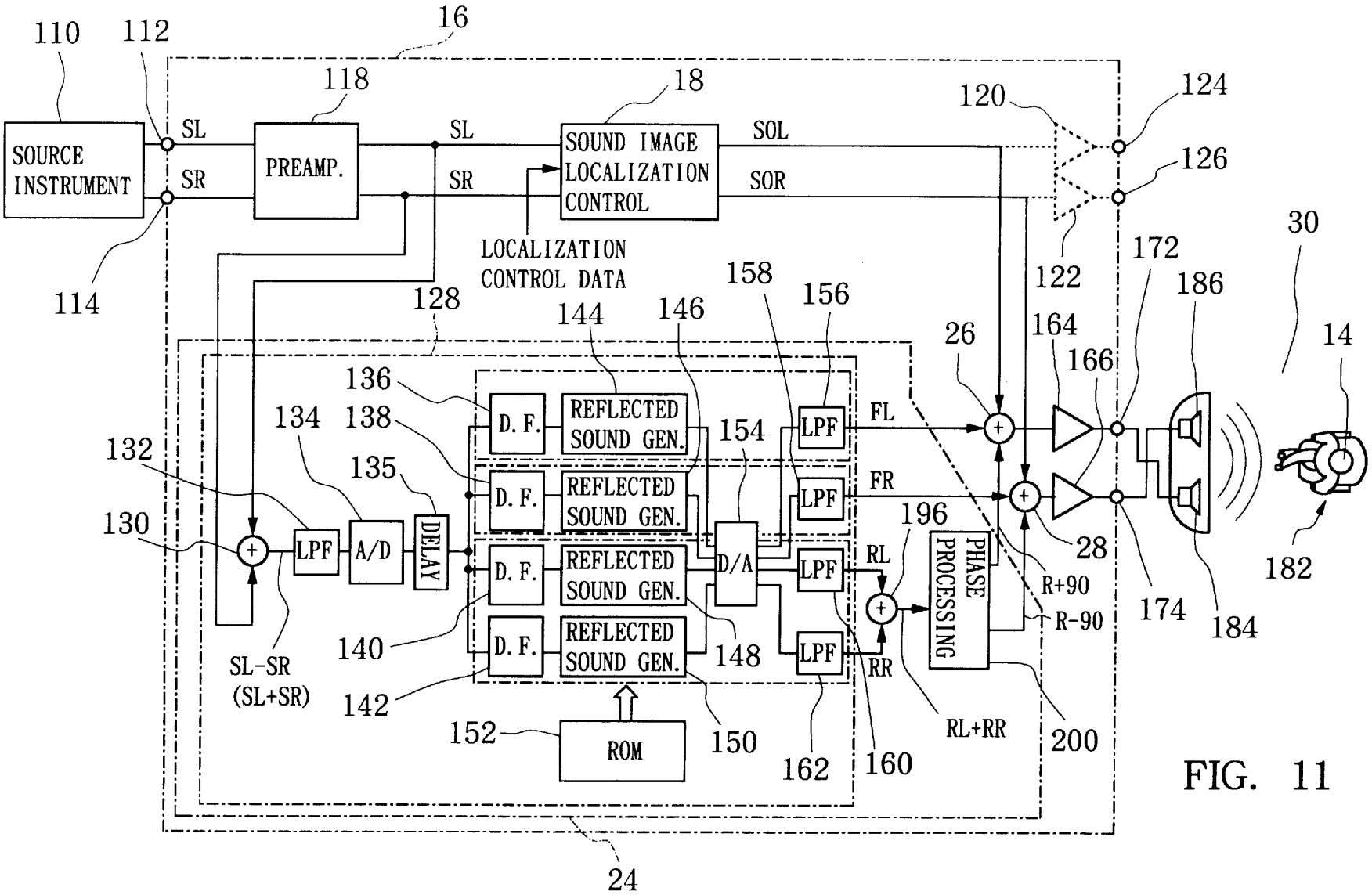
FIG. 11 is a block diagram illustrating a detailed structural example of a sound field processing circuit shown in FIG. 5.

As shown by broken lines in FIG. 11, there may be further provided power amplifiers 120 and 122 and output terminals 124 and 126 for the main signals, so that the main signals are reproduced via other speakers (not shown) connected to the terminals 124 and 126. In such a case, it is possible to stop, such as by switches, the supply to the adders 26 and 28 of the main signals SOL and SOR.

Figure 16:
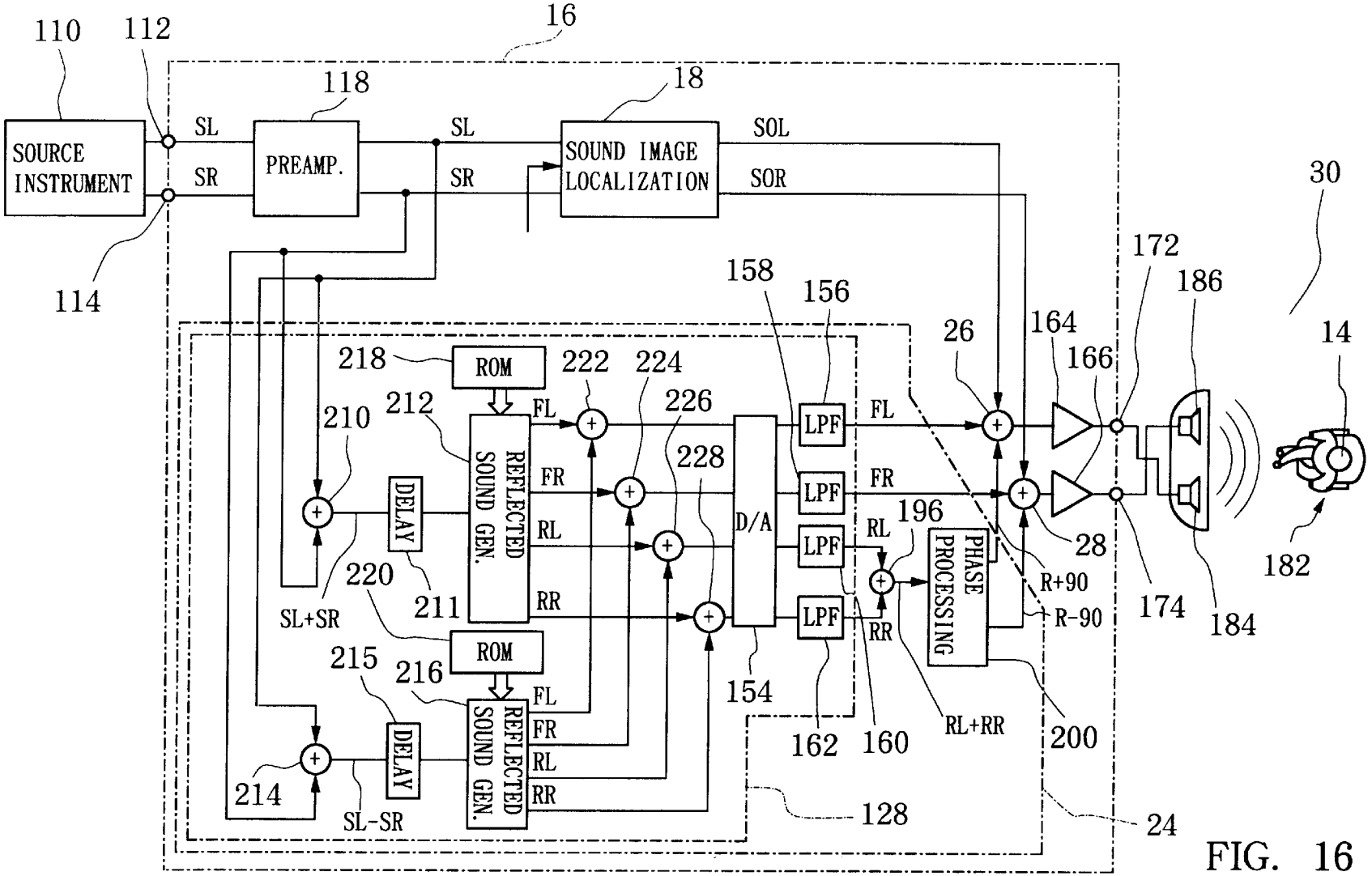
FIG. 16 is a block diagram illustrating another detailed example of the sound field processing circuit of FIG. 1.

In FIG. 16, there is shown another example of the sound field processing circuit 24 of FIG. 1, which is designed to generate reflected sound signals for both the sum signal SL+SR and the difference signal SL−SR originating from the main signal SL and SR by use of different reflected sound parameters. The sum of the main signals SL and SR (SL+SR) is calculated by an adder 210, delayed about 5 ms by a delay circuit 211 and then fed to a reflected sound generation section 212. The difference of the main signals SL and SR (SL−SR) is calculated by a subtracter 214, delayed about 5 ms by a delay circuit 215 and then fed to a reflected sound generation section 216. Each of the reflected sound generation sections 212, 216, although not specifically shown here, comprises the low-pass filter 132, A/D converter 134, digital filters 136, 138, 140, 142 and reflected sound generation circuits 144, 146, 148, 150 of FIG. 11, and it performs convolution operations, by use of the reflected sound parameters stored in a ROM 216 or 218, to generate reflected sound signals. The sum signal SL+SR represents a central localized component of a conversation or the like, and thus reflected sound parameters are applied here which are of such a pattern to impart a sound field giving relatively narrow spatial impression. On the other hand, the difference signal SL−SR represents a non-central localized component, and thus reflected sound parameters are applied here which are of such a pattern to impart a sound field giving relatively wide spatial impression.

The reflected sound signals output from the generation sections 212 and 216 are fed to adders 222, 224, 226, 228, where the signals of every same channel are added together. The added signals are then time-divisionally converted into analog representation via a D/A converter 154. The outputs signals of the D/A converter 154 are then smoothed by means of corresponding low-pass filters 156, 158, 160 and 162, and ultimately output from the reflected sound signal generation section 128 in analog form.

Of the four-direction reflected sound signals, the signals RL and RR for the rear-left and rear-right directions are added together by an adder 196 and fed to a phase processing circuit 200, which processes the added signal to vary in shift in accordance with its frequency, so as to create two reflected sound signals R+90 and R−90 which are displaced in phase from each other by 180° and are substantially the same in amplitude level. The reflected sound signals R+90 and R−90 are added by adders 26 and 28 to the reflected sound signals FL and FR for the front-left and front-right directions and the left- and right-channel source signals (main signals) L and R, respectively. The resultant added signals output from the adders 26 and 28 are led via power amplifiers 164 and 166 to speaker output terminals 172 and 174, respectively, by way of which the signals are supplied to respective speakers 184 and 184 disposed in front of a sound listening point 182 (i.e., listener 14). In this manner, the main and reflected sound signals will be reproduced from the main speakers 184 and 186. By the use of two different sets of reflected sound parameters as mentioned above, it is allowed to impart abundant spatial impression to the non-central localized component while imparting a feeling of an appropriate sound field to the central localized component such as of a conversation.

Figure 17:
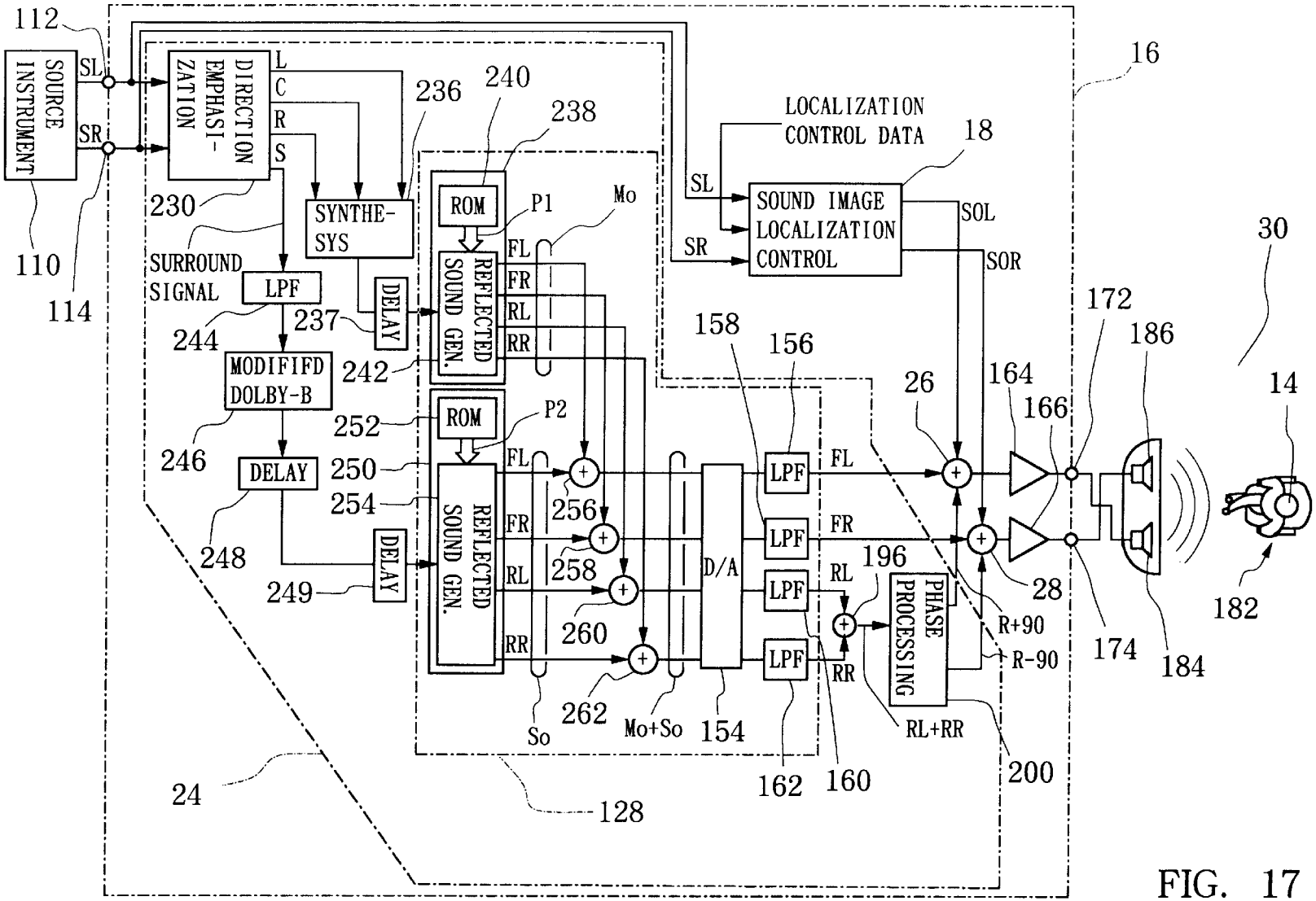
FIG. 17 is a block diagram illustrating still another detailed example of the sound field processing circuit of FIG. 1.

In FIG. 17, there is shown in detail another example of the sound field processing circuit 24 of FIG. 1, which is intended for generation of reflected sounds that impart a feeling of "being surrounded" as in a 70 mm motion picture theater. Source instrument 110 outputs, as left- and right-channel source signals SL and SR, Dolby-Surround (trade name)-encoded signals from an LV (Laser Vision Disk) player or reproduced signals of a VTR, which are then applied to input terminals 112 and 114. Direction emphasization circuit 230 compares the levels of the input signals SL, SR, SL+SR and S−L to control the individual-channel signal levels on the basis of the comparison result, to thereby supply four-channel signals L, C, R and S via a matrix circuit.

Of the four-channel signals, the signals L, R and C are additively added by a synthesis section 236, and sent to a main sound field creation section 238 via a delay circuit 237 that provides a time delay of about 5 ms for imparting a sound field after the settlement of sound localization. The main sound field creation section 238 performs convolution operations by use of reflected sound parameters P1 read out from a ROM 240, so as to create reflected sound signals M0 giving a first sound field for a synthesized signal of the signals L, S, and C.

To realize the atmosphere of a 70 mm motion picture theater, it is preferable that the reflected sound parameters P1 are those for a relatively tight sound field where effect sounds and music sounds expand deep into the screen. Reflected sound generation section 242 comprises for example the low-pass filter 132, A/D converter 134, digital filters 136, 138, 140, 142 and reflected sound generation circuits 144, 146, 148, 150 of FIG. 11, and it performs convolution operations, by use of the reflected sound parameters P1 stored in a ROM 240, to generate reflected sound signals (main sound field signals) M0.

Surround signal S output from the Direction emphasization circuit 230 is sent to a surround sound field signal creation section 250, via a 7 kHz low-pass filter 244, modified Dolby-B noise reduction circuit 246, delay circuit 248 providing a time delay of 15 to 30 ms and delay circuit 249 providing a time delay of about 5 ms to execute the sound field impartment processing after the settlement of sound image localization.

The surround sound field signal creation section 250 performs convolution operations by use of reflected sound parameters P2 read out from a ROM 252, so as to create reflected sound signals (surround sound field signals) SO giving a second sound field for the surround signal S, and it includes a reflected sound generation section 254 constructed similarly to the above-mentioned main sound field creation section 238. To realize the atmosphere of a 70 mm motion picture theater, it is preferable that the reflected sound parameters P2 are those giving an extensive surround sound field where sound images are localized to encircle the listener.

The main and surround sound field signals M0 and S0 created by the main and surround sound field creation sections 238 and 250 are fed to adders 256, 258, 260, 262, where the signals of every same channel are additively synthesized respectively. The synthesized signals are then time-divisionally converted into analog representation via the D/A converter 154. The outputs signals of the D/A converter 154 are distributed to the individual channels to be passed through the corresponding low-pass filters 156, 158, 160 and 162, and then ultimately output from the reflected sound generation section 128.

Of the four-direction reflected sound signals, the signals RL and RR for the rear-left and rear-right directions are added together by the adder 196 and fed to the phase processing circuit 200, which processes the added signal to vary in shift in accordance with its frequency, so as to create two reflected sound signals R+90 and R−90 which are displaced in phase from each other by 180° and are substantially the same in amplitude level. The reflected sound signals R+90 and R−90 are added by adders 204 and 206 to the reflected sound signals FL and FR for the front-left and front-right directions and the left- and right-channel source signals (main signals) L and R, respectively. The resultant added signals output from the adders 204 and 206 are led via the power amplifiers 164 and 166 to the speaker output terminals 172 and 174, respectively, by way of which the two-channel signals are supplied to the respective speakers 184 and 184 (each of which may be a speaker of a cassette deck provided with a radio) disposed in front of the sound listening point 182 (i.e., the listener 14). In this manner, the main and reflected sound signals will be reproduced together from the main speakers 184 and 186. This permits the listener to appreciate a motion picture or the like while enjoying the atmosphere of a 70 mm motion picture theater.

Figure 18:
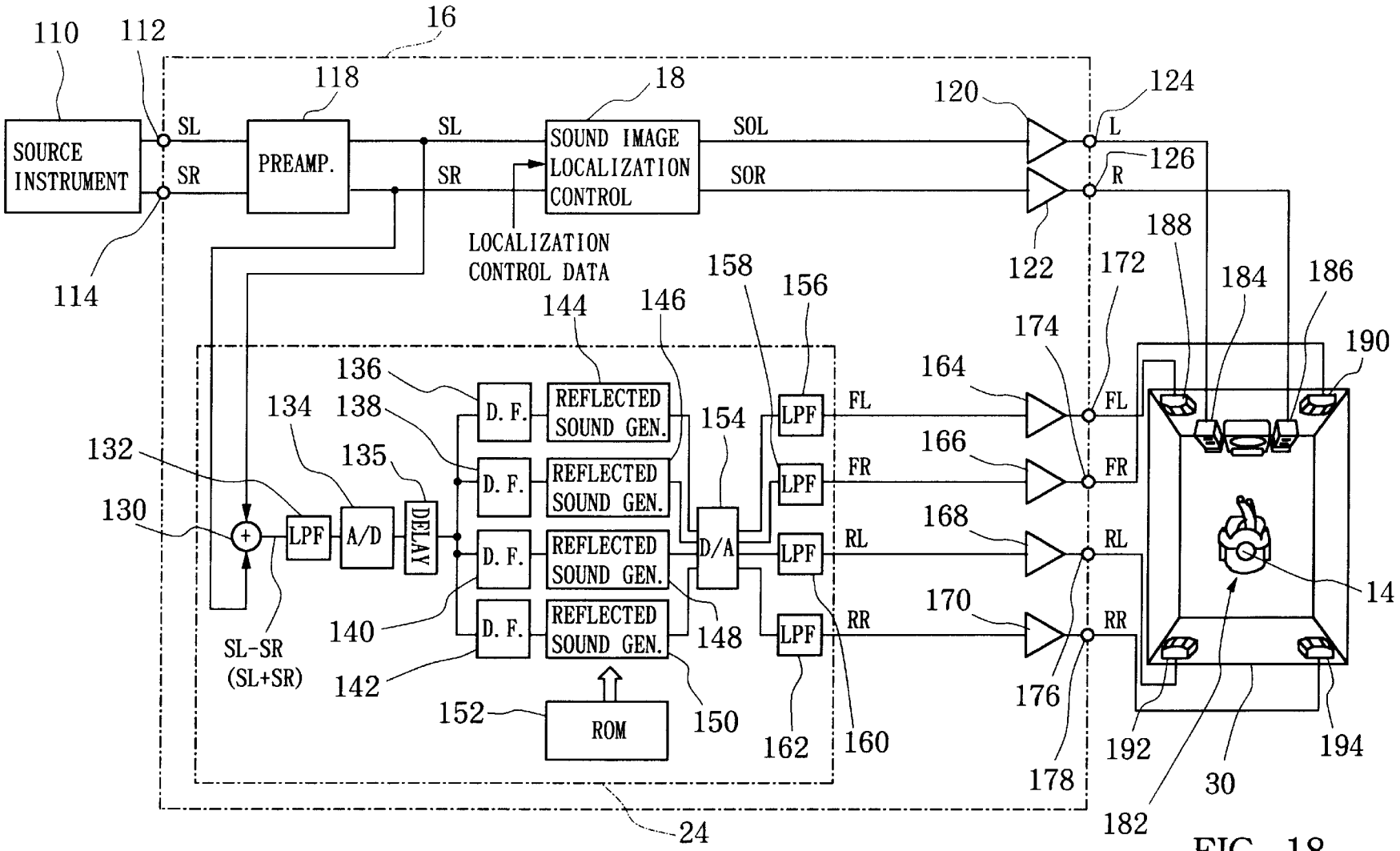
FIG. 18 is a block diagram illustrating another embodiment of the present invention.

Another embodiment of the present invention is shown in FIG. 18, where sound field effect sub-speakers 188, 190, 192 and 194 are disposed at four corners of a listening room 30 in addition to main speakers 184 and 186, and reflected sound signals FL, FR, RL and RR are supplied, via power amplifiers 164, 166, 168 and 170 and output terminals 172, 174, 174 and 176, to the sub-speakers 188, 190, 192 and 194. Main signals SOL and SOR having undergone the sound localization processing are supplied, via power amplifiers 120 and 122 and output terminals 124 and 126, to the main speakers 184 and 186.

Figure 19:
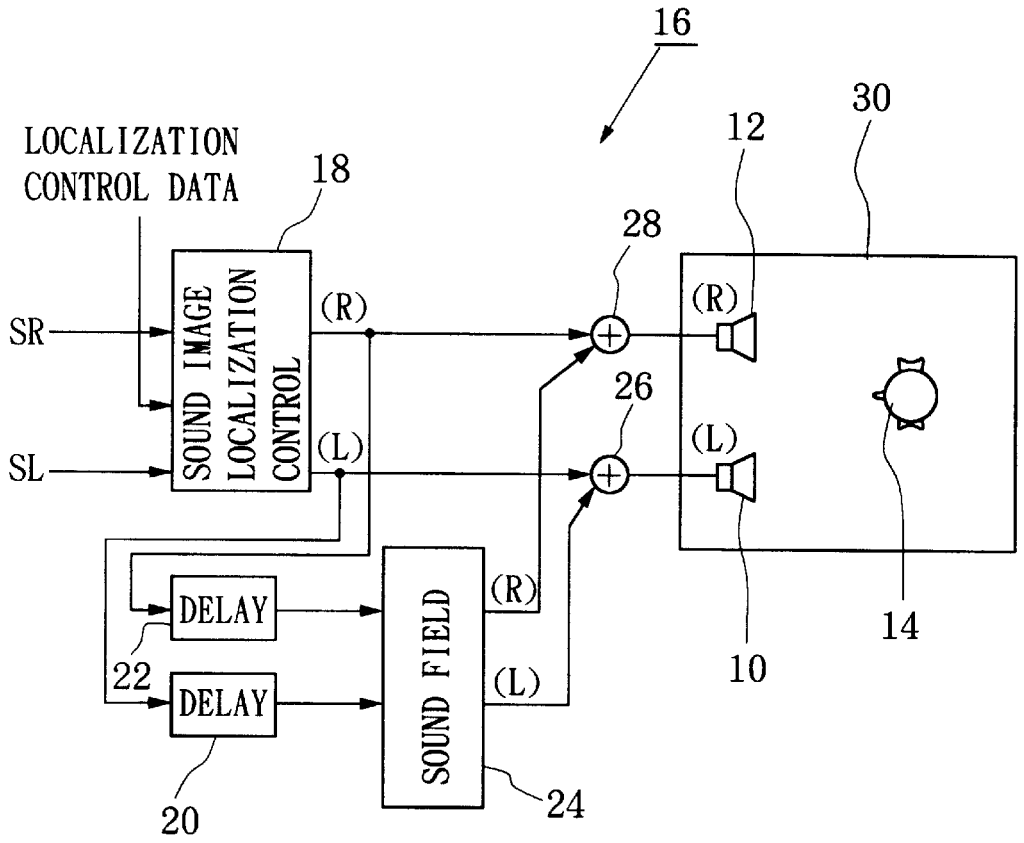
FIG. 19 is a block diagram illustrating still another embodiment of the present invention.
Figure 20:
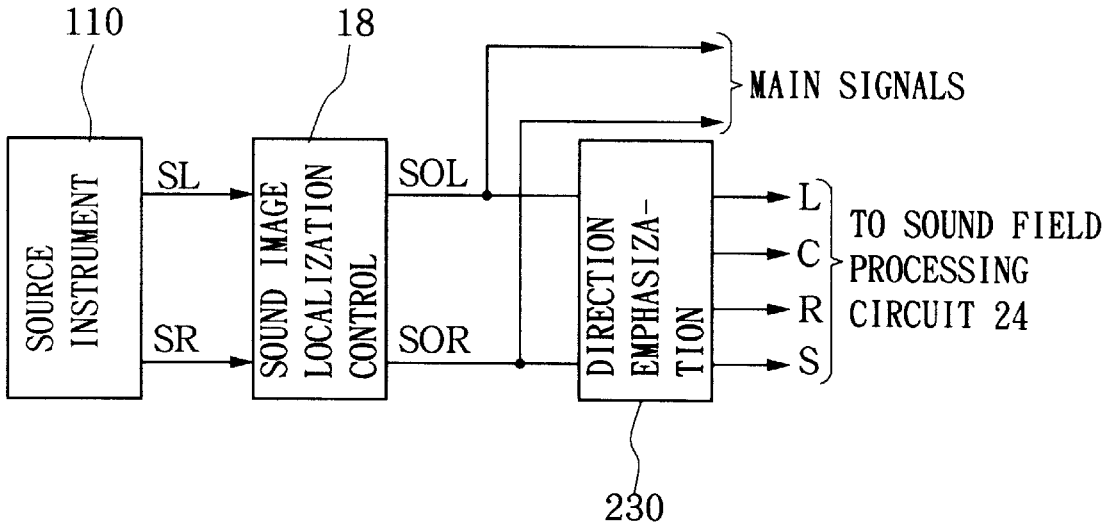
FIG. 20 is a block diagram illustrating a structural example where the embodiment of FIG. 19 is applied to the technique shown in FIG. 17.

In FIG. 19, there is shown still another embodiment of the present invention, which is designed to supply a sound field processing circuit 24 with signals having undergone the sound localization processing in a sound image localization circuit 18. According to the embodiment, the sound image localization circuit 18 can be incorporated into the source instrument 110 or preamplifier 118 of the example shown in FIG. 11, 16 or 18. Further, in the example of FIG. 17, the sound image localization circuit 18 may be disposed ahead of the Direction emphasization circuit 230 as shown in FIG. 20 so that the main signals are branched out from the output of the circuit 18.

According to the present invention so far described, a sound field can be imparted by simple construction because the sound field impartment is effected, separately from the sound image localization control of direct sounds. Further, because the sound image localization processing is initiated before the sound field impartment processing is initiated so that the two processings are performed with some time difference, it is possible to prevent the impartment of the sound field effect from adversely influencing the sound image localization to thereby achieve good results in both the sound image localization and the sound field effect impartment.

What is claimed is:

1. A sound image and sound field controlling device comprising:

sound image localization controlling means for generating a direct sound image by reproducing an input audio signal via a plurality of speakers, wherein said sound image localization controlling means applies predetermined delay signal processing to the input audio signal to thereby perform sound image localization processing to localize a sound image of a direct sound in a desired range including an area outside a space surrounded by the speakers; and sound field controlling means for generating reflected sounds by reproducing the input audio signal via the speakers, wherein said sound field controlling means performs a convolution operation on the audio signal using impulse response characteristics of desired reflected sounds, based on reflected sound data determined in correspondence with hypothetical sound source positions of possible reflected sounds in an acoustic space, to thereby perform sound field impartment processing to impart a sound field effect, wherein said speakers are disposed with respect to a predetermined sound-listening point so as to generate a multiplicity of the reflected sounds in the acoustic space or a model space similar thereto, wherein said sound image localization processing is initiated on the input audio signal prior to said sound field impartment processing.

2. A sound image and sound field controlling device as defined in claim 1, wherein said sound field impartment processing by said sound field controlling means is initiated after completion of said sound image localization processing by said sound image localization controlling means.

3. A sound image and sound field controlling device as defined in claim 2, wherein a time difference of at least 5 ms is provided between initiation of said sound image localization processing by said sound image localization controlling means and initiation of said sound field impartment processing by said sound field controlling means.

4. A sound image and sound field controlling device for generating direct and reflected sounds comprising:

sound image localization controlling means for generating a direct sound image by reproducing an input audio signal via a plurality of speakers, wherein said sound image localization controlling means applies predetermined delay signal processing to the input audio signal to thereby perform sound image localization processing to localize a sound image of a direct sound in a desired range including an area outside a space surrounded by the speakers; and sound field controlling means for generating reflected sounds by reproducing the input audio signal via the speakers, wherein said sound field controlling means performs a convolution operation on the audio signal using impulse response characteristics of desired reflected sounds, based on reflected sound data determined in correspondence with hypothetical sound source positions of possible reflected sounds in an acoustic space, to thereby perform sound field processing to impart a sound field effect, wherein said speakers are disposed with respect to a predetermined sound-listening point so as to generate a multiplicity of the reflected sounds in the acoustic space or a model space similar thereto, wherein said sound image localization processing of the input audio signal generates a direct sound image before said sound field impartment processing generates a corresponding first reflected sound.

* * * * *